US006981938B2

(12) United States Patent
Ruthenberg et al.

(10) Patent No.: US 6,981,938 B2
(45) Date of Patent: Jan. 3, 2006

(54) BOOKLET MAKER WITH CREASE ROLLS HAVING A SLIP CLUTCH

(75) Inventors: Raymond M. Ruthenberg, Toronto (CA); Joseph M. McNamara, Mississauga (CA); David C. Van Wyngaarden, Toronto (CA); Steven K. Siu, Mississauga (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/642,410

(22) Filed: Aug. 15, 2003

(65) Prior Publication Data

US 2005/0037908 A1 Feb. 17, 2005

(51) Int. Cl.
*B31F 1/00* (2006.01)

(52) U.S. Cl. ..... 493/395; 493/424

(58) Field of Classification Search ..... 493/395, 493/397, 403, 424, 434, 437, 442, 444
See application file for complete search history.

(56) References Cited

U.S. PATENT DOCUMENTS

| | | | | |
|---|---|---|---|---|
| 2,813,714 A | | 11/1957 | Herrick et al. | 270/68 |
| 3,627,304 A | * | 12/1971 | Reeder et al. | 493/410 |
| 3,671,033 A | | 6/1972 | Coast | 270/83 |
| 3,809,387 A | * | 5/1974 | Heist et al. | 493/10 |
| 3,975,009 A | * | 8/1976 | Brown | 493/14 |
| 4,023,789 A | * | 5/1977 | Touchette | 270/58.27 |
| 5,090,671 A | * | 2/1992 | Gombault et al. | 270/45 |
| 5,316,280 A | | 5/1994 | Watkiss | 270/37 |
| 5,564,684 A | * | 10/1996 | Salancy | 270/45 |
| 5,738,620 A | | 4/1998 | Ebner et al. | 493/445 |
| 5,766,122 A | * | 6/1998 | Hamilton | 493/420 |
| 6,196,147 B1 | * | 3/2001 | Burton et al. | 112/470.16 |
| 6,224,530 B1 | * | 5/2001 | Okelmann et al. | 493/420 |
| 6,276,677 B1 | | 8/2001 | Hommochi et al. | 270/32 |
| 6,491,614 B1 | * | 12/2002 | Harding | 493/24 |
| 6,511,407 B2 | * | 1/2003 | Wahl | 493/405 |
| 6,568,668 B1 | * | 5/2003 | Wakabayashi et al. | 270/58.11 |
| 6,602,177 B2 | * | 8/2003 | Muir | 493/424 |

FOREIGN PATENT DOCUMENTS

| | | |
|---|---|---|
| DE | 101 22 113 A1 | 11/2001 |
| JP | 2004106976 | 4/2004 |

* cited by examiner

*Primary Examiner*—Eugene Kim
(74) *Attorney, Agent, or Firm*—R. Hutter

(57) ABSTRACT

In a booklet maker or sheet folder wherein one or more sheets are pushed through a nip formed by a pair of crease rolls, and wherein the crease rolls are driven by gears, a slip clutch is operatively disposed between one of the crease rolls and the gear driving the crease roll. The slip clutch compensates for the abrupt change in frictional coefficient experienced by the crease rolls when one or more sheets enter the nip.

8 Claims, 4 Drawing Sheets

BOOKLET MAKER WITH CREASE ROLLS HAVING A SLIP CLUTCH

TECHNICAL FIELD

The present disclosure relates to automated booklet makers, in which sheets forming a booklet are folded by passing through a pair of crease rolls.

BACKGROUND

Booklet makers are well-known devices for forming folded booklets which are stapled along the crease thereof. It is becoming common to include booklet makers in conjunction with office-range copiers and printers (as used herein, a "copier" will be considered a type of "printer"). In basic form, a booklet maker includes a slot for accumulating signature sheets, as would be produced by a printer. The accumulated sheets, forming the pages of a booklet, are positioned within the stack so that a stapler mechanism and complementary anvil can staple the stack precisely along the intended crease line. In one embodiment, the creased and stapled sheet sets are then pushed, by a blade, completely through crease rolls, to form the final main fold in the finished booklet. The finished booklets are then accumulated in a tray downstream of the crease rolls.

A practical problem with booklet makers having crease rolls relates to the fact that, when a set of sheets to be folded into a booklet enters the nip formed by the crease rolls, there is a sudden change in frictional coefficient between the crease rolls, especially between the outermost sheet in the folded set (such as forming the cover of the booklet) and the neighboring sheet in the set. The change in torque between the crease rolls can result in damage to the outer sheet of the set.

PRIOR ART

U.S. Pat. No. 2,183,714 shows a slip clutch in the context of a machine for folding sheets.

U.S. Pat. No. 5,316,280 shows an example of a current practical booklet maker design.

SUMMARY

According to one aspect, there is provided an apparatus for folding sheets, comprising a first crease roll, disposed on a first axle and a second crease roll, disposed on a second axle. The first crease roll and second crease roll are arranged to form a nip therebetween. A first drive member is disposed on the first axle, and a second drive member is disposed on the second axle, engaging the first drive member. A slip element is operatively disposed between the second drive member and the second axle.

According to another aspect, there is provided a method of operating an apparatus for folding sheets, the apparatus including a first roll and a second roll arranged to form a nip therebetween. A torque is transmitted from the first roll to the second roll. At least one sheet is urged through the nip, thereby folding the sheet. The transmitted torque is limited as a result of an effective change in frictional coefficient between the first roll and the second roll.

DETAILED DESCRIPTION

Figure 1:
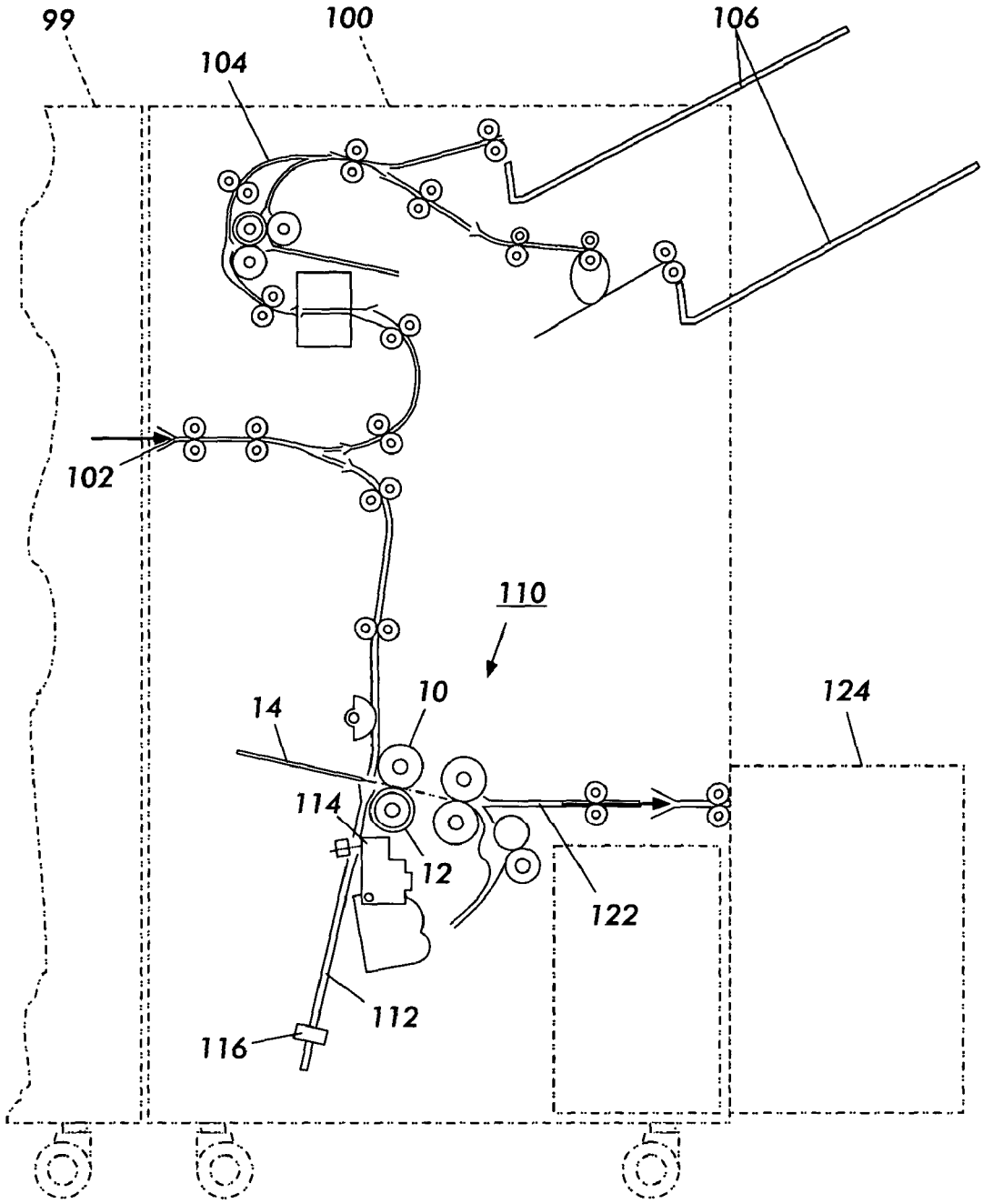
FIG. 1 PRIOR ART
FIG. 1 is a simplified elevational view of a finisher module as would be used with a mid-range copier or printer.

FIG. 1 is a simplified elevational view of a "finisher module," generally indicated as 100, including a booklet maker, as would be used with an office-range digital printer. Printed signature sheets from the printer 99 are accepted in an entry port 102. Depending on the specific design of finisher module 100, there may be numerous paths such as 104 and numerous output trays 106 for print sheets, corresponding to different desired actions, such as stapling, hole-punching and C- or Z-folding. It is to be understood that the various rollers and other devices which contact and handle sheets within finisher module 100 are driven by various motors, solenoids and other electromechanical devices (not shown), under a control system, such as including a microprocessor (not shown), within the finisher module 100, printer 99, or elsewhere, in a manner generally familiar in the art. For present purposes what is of interest is the booklet maker generally indicated as 110.

Booklet maker 110 defines a "slot" which is here indicated as 112. Slot 112 accumulates signature sheets (sheets each having four page images thereon, for eventual folding into pages of the booklet) from the printer 99. Each sheet is held within slot 112 at a level where a stapler 114 can staple the sheets along a midline of the signatures, the midline corresponding to the eventual crease of the finished booklet. In order to hold sheets of a given size at the desired level relative to the stapler 114, there is provided at the bottom of slot 112 an elevator 116, which forms the "floor" of the slot 112 on which the edges of the accumulating sheets rest before they are stapled. The elevator 116 is placed at different locations along slot 112 depending on the size of the incoming sheets.

As printed signature sheets are output from printer 99, they accumulate in slot 112. When all of the necessary sheets to form a desired booklet are accumulated in slot 112, elevator 116 is moved from its first position to a second position where the midpoint of the sheets are adjacent the stapler 114. Stapler 114 is activated to place one or more staples along the midpoint of the sheets, where the booklet will eventually be folded.

After the stapling, elevator 116 is moved from its second position to a third position, where the midpoint of the sheets are adjacent a blade 14 and a nip formed by crease rolls 10 and 12. The action of blade 14 and crease rolls 10 and 12 performs the final folding, and sharp creasing, of the sheets into the finished booklet. Blade 14 contacts the sheet set along the stapled midpoint thereof, and bends the sheet set toward the nip of crease rolls 10 and 12, which draw all the sheets in and form a sharp crease. The creased and stapled sheet sets are then drawn, by the rotation of crease rolls 10 and 12, completely through the nip, to form the final main fold in the finished booklet. The finished booklets are then conducted along path 122 and collected in a tray 124.

Figure 2:
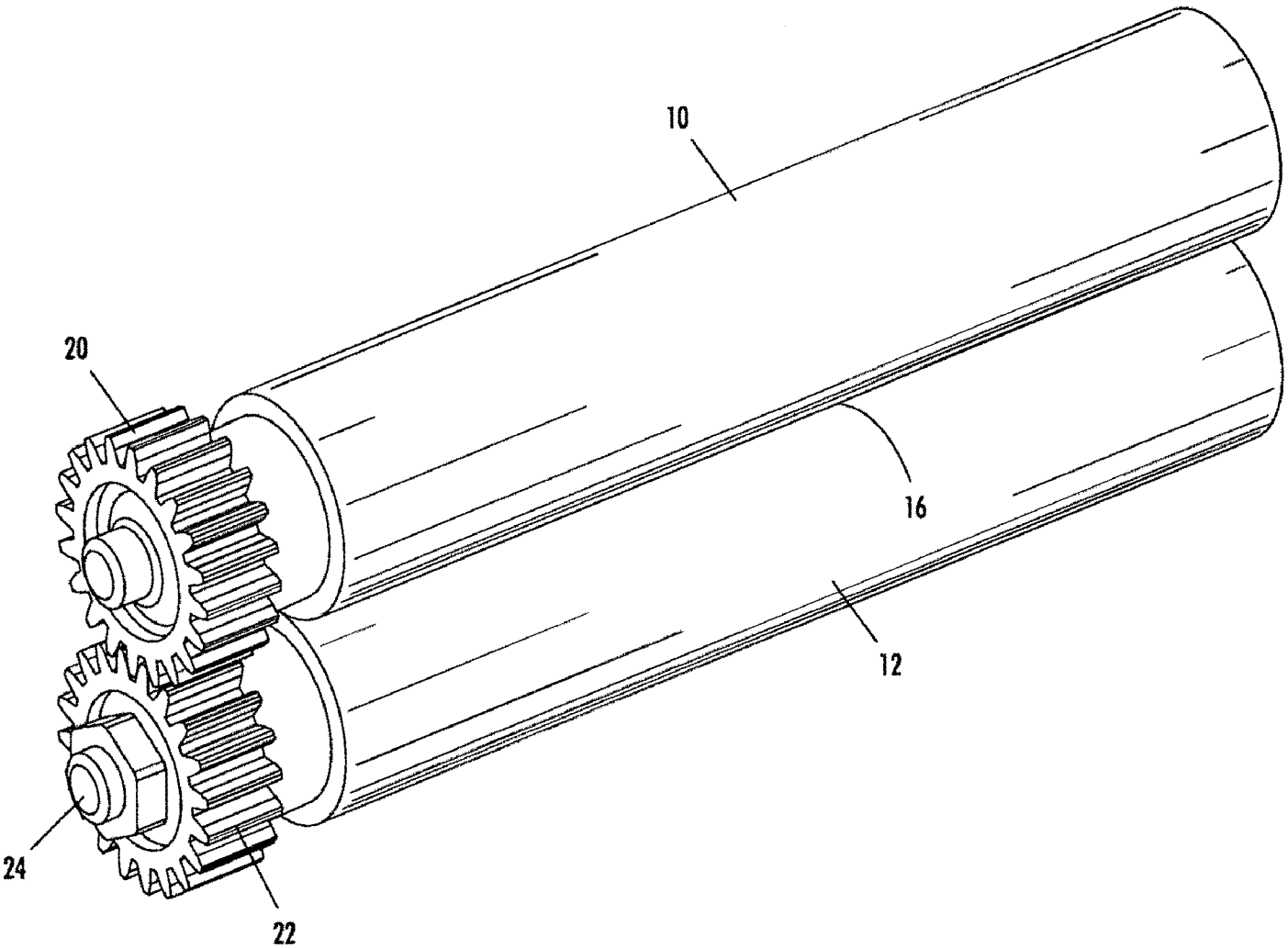
FIG. 2 shows crease rolls, as would be used in the finisher of FIG. 1, with an associated mechanism, in isolation.

Of particular interest to the present disclosure is a mechanism associated with the crease rolls 10 and 12, which are shown in isolation in FIG. 2. As shown in the Figure, crease rolls 10 and 12 generally contact each other along longitudes thereof, shown as nip 16. When a set of sheets is caused to be creased as described above, the folded set of sheets is drawn through nip 16 by frictional engagement with the crease rolls 10 and 12.

Each crease roll 10 and 12 shares an axle with a drive gear, shown as 20 and 22 respectively. The crease rolls are driven by an external motor, not shown, which drives one of the gears 20 or 22, with the other gear in effect following the driven gear. So, when there are no sheets in nip 16, the two contacting crease rolls 10 and 12 ride on each other, while simultaneously the two gears (or, more broadly, "drive members," which could be for example toothless wheels, or include a pulley arrangement, etc.) act with one gear driving the other. In order for such a system to work properly, the effective circumferences of the gears 20 and 22 must correspond closely to the circumferences of the crease roll 10 and 12: otherwise, there will be a velocity mismatch between the crease rolls and the drive members, causing a shear load along nip 16, resulting in slipping between the crease rolls along nip 16.

As mentioned above, when a set of sheets, such as forming a booklet, is pushed through nip 16, there will be in effect a major change in frictional coefficient between the crease rolls 10 and 12, when the outermost sheet (such as the cover of the booklet) in the folded set is acquired. This change in frictional coefficient causes slipping between the outermost sheet in the folded set (such as the cover of the booklet) and the neighboring sheet in the set. The change in torque between the crease rolls can result in damage to the outer sheet of the set in the staple area, causing additional crumpling toward a trail end of the moving sheet set. Compounding the effect is the fact, while the coefficient of friction between the crease roll 10 and 12 changes when the sheets enter the nip 16, the effective coefficient of friction between gears 20 and 22 stays constant.

To address this problem, there is provided a slip element, in the form of a slip clutch 24 in this embodiment, operatively disposed between one of the gears such as 22 and its corresponding crease roll 12. The function of such a slip element is to allow a certain required torque to be transmitted from the driven member to the following member, but to limit this transmitted torque so that sudden changes in the frictional coefficient (such as when a set of sheets are acquired by the crease rolls) have a site to slip at instead of between the outermost sheet in the folded set (such as the cover of the booklet) and the neighboring sheet in the set. This new slip site prevents the crumpling, tearing, or other damage to the sheet set as mentioned above.

Figure 3:
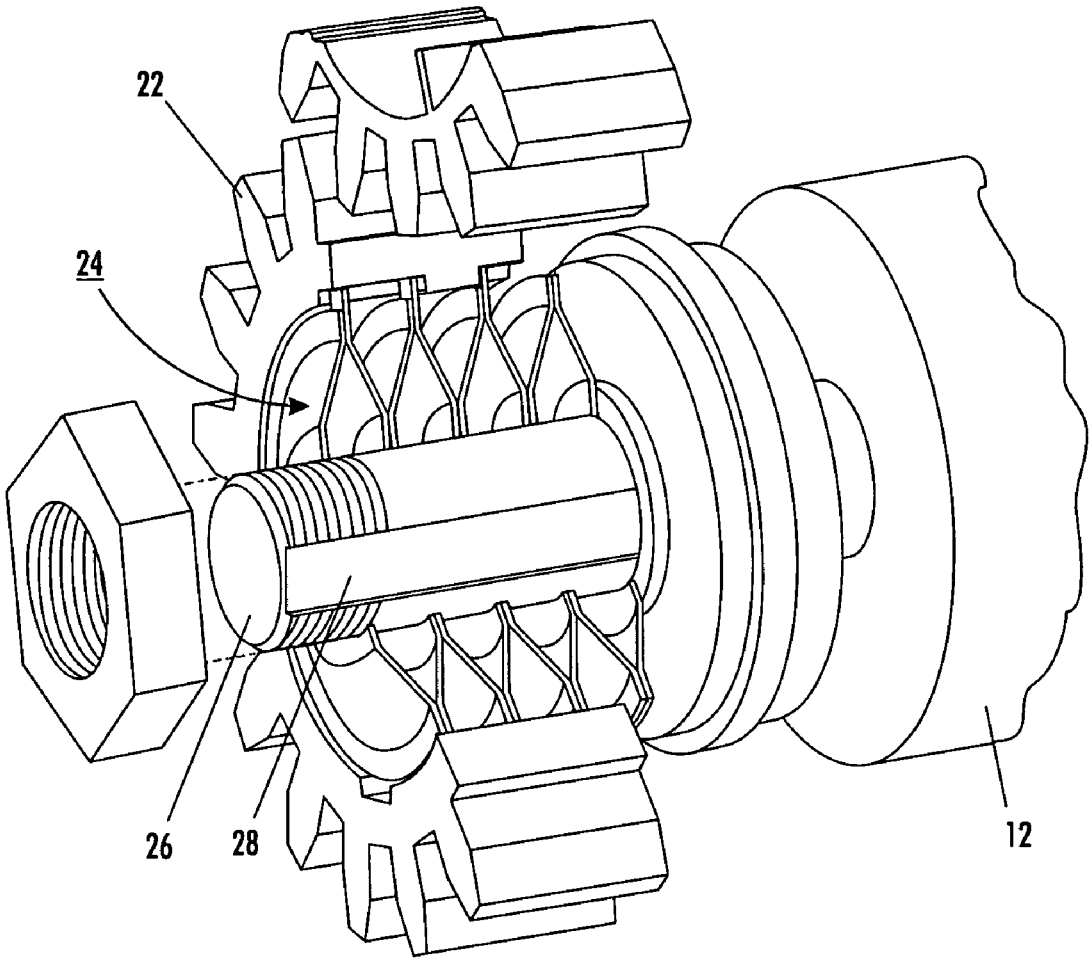
FIG. 3 is a cutaway view.
Figure 4:
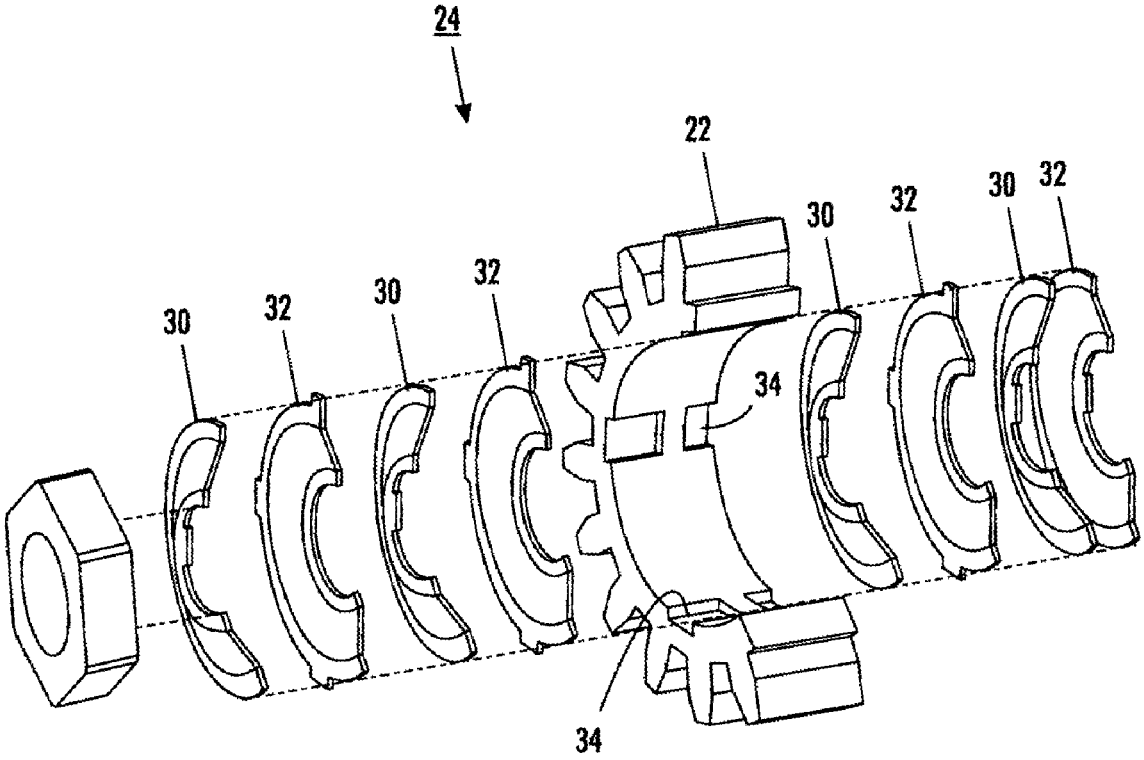
FIG. 4 is an exploded, partially sectional view, of a slip clutch that can be used with the mechanism of FIG. 2.

FIG. 3 is a cutaway view, and FIG. 4 is an exploded, sectional view, of a slip clutch 24 that can be used with the mechanism of FIG. 2, operatively disposed between the gear 22 and the crease roll 12. In this embodiment, the slip clutch includes a set of what are known as "Belleville washers," which are concave-convex springable washers arranged in an alternating fashion. As can be seen by comparing the views of FIG. 3 and 4, every other washer 30 is keyed to engage a flat surface 28 in the center axle 26 of roller 12, and alternating washers 32 are keyed to slots 34 on the inner surface of gear 22. (It will be understood that FIG. 4 is a sectional view; in a practical embodiment, each washer 30, 32 is substantially disk-shaped, and not semi-circular, as shown.) The overall effect of the Belleville washers used in this way is that a certain degree of slip is permitted between gear 22 and axle 26, which is rigidly attached to crease roll 22.

Although a mechanical slip clutch is here illustrated, other types of slip clutch or slip element may be used, such as a wrap-spring clutch or a magnetic clutch.

What is claimed is:

1. An apparatus for folding sheets, comprising:

a first crease roll, disposed on a first axle;

a second crease roll, disposed on a second axle;

the first crease roll and second crease roll being arranged to form a nip therebetween;

a first drive member disposed on the first axle;

a second drive member disposed on the second axle, engaging the first drive member;

a slip element operatively disposed between the second drive member and the second axle and a movable blade for pushing a plurality of sheets through the nip, thereby folding the sheet.

2. The apparatus of claim 1, wherein the first drive member is a first gear and the second drive member is a second gear engaging the first gear.

3. The apparatus of claim 1, wherein the slip element is a slip clutch.

4. The apparatus of claim 1, wherein the slip clutch includes a Belleville washer.

5. A method of folding a plurality of sheets using an apparatus including a first roll and a second roll arranged to form a nip therebetween, comprising:

transmitting a torque from the first roll to the second roll;

urging the plurality of sheets through the nip, thereby folding the sheets into a folded set of sheets;

limiting the transmitted torque as a result of an effective change in frictional coefficient between the first roll and the second roll, thereby limiting sliding between sheets as the sheets pass through the nip providing a first drive member associated with the first roll and a second drive member associated with the second roll, the second drive member engaging the first drive member;

the limiting step including permitting a slip between the second drive member and the second roll; and advancing a blade to urge the at least one sheet through the nip.

6. The method of claim 5, wherein the first drive member is a first gear and the second drive member is a second gear engaging the first gear.

7. The method of claim 5, the limiting step including permitting a slip between the first drive member and the first roll.

8. The method of claim 5, further comprising urging a plurality of sheets through the nip simultaneously, thereby folding the sheets.

* * * * *